United States Patent [19]

Christini et al.

[11] Patent Number: 4,695,320

[45] Date of Patent: Sep. 22, 1987

[54] MAGNESIUM REFINING PROCESS

[75] Inventors: Roy A. Christini, Apollo, Pa.; Kenneth P. Frizzell, Chewelah, Wash.

[73] Assignee: Aluminum Company of America, Pittsburgh, Pa.

[21] Appl. No.: 786,903

[22] Filed: Oct. 11, 1985

[51] Int. Cl.[4] ..... C22B 26/22

[52] U.S. Cl. ..... 75/67 A; 75/67 R; 75/93 AB

[58] Field of Search ..... 75/67 R, 67 A, 93 AB

[56] References Cited

U.S. PATENT DOCUMENTS

| | | | |
|---|---|---|---|
| 1,524,470 | 1/1925 | Beielstein . | |
| 1,754,788 | 4/1930 | Gann . | |
| 2,283,099 | 5/1942 | Schichtel et al. | 75/67 A |
| 4,099,965 | 7/1978 | Béguin et al. | 75/68 R |
| 4,384,887 | 5/1983 | Skach, Jr. et al. | 75/0.5 B |
| 4,543,122 | 9/1985 | Bodenstein et al. | 75/67 R |

FOREIGN PATENT DOCUMENTS 122312 12/1900 Fed. Rep. of Germany .

OTHER PUBLICATIONS

Lawrence H. Van Vlack, *Elements of Materials Science and Engineering* (fourth edition), 1980, p. 532, Appendix D.

Kenneth A. Bowman, Magnesium by the Magnetherm Process—Process Contamination and Fused Salt Refining, *Light Metals* 1986, vol. 2, pp. 1033–1038.

Jean-Marie Logerot and Andre Michel Mena, Extractive Metallurgy—Latest Developments of the Magnetherm Process, as presented at the 109th AIME Annual Meeting—Las Vegas, Nevada—Feb. 24–28, 1980, pp. 1–31.

*Primary Examiner*—Melvyn J. Andrews

*Attorney, Agent, or Firm*—Daniel A. Sullivan, Jr.; Douglas P. Mueller

[57] ABSTRACT

Disclosed is a process for refining magnesium crude containing between about 0.7 and 1.5 wt. % calcium. The process includes mixing a flux containing from about 55 to 85 wt. % magnesium chloride and 45 to 15 wt. % alkali chlorides into a molten body of the crude. Refined magnesium is thereby produced, as well as a sludge containing calcium chloride which never has a liquidus exceeding the temperature of the molten body. The refined magnesium is then separated from the sludge.

9 Claims, 1 Drawing Figure

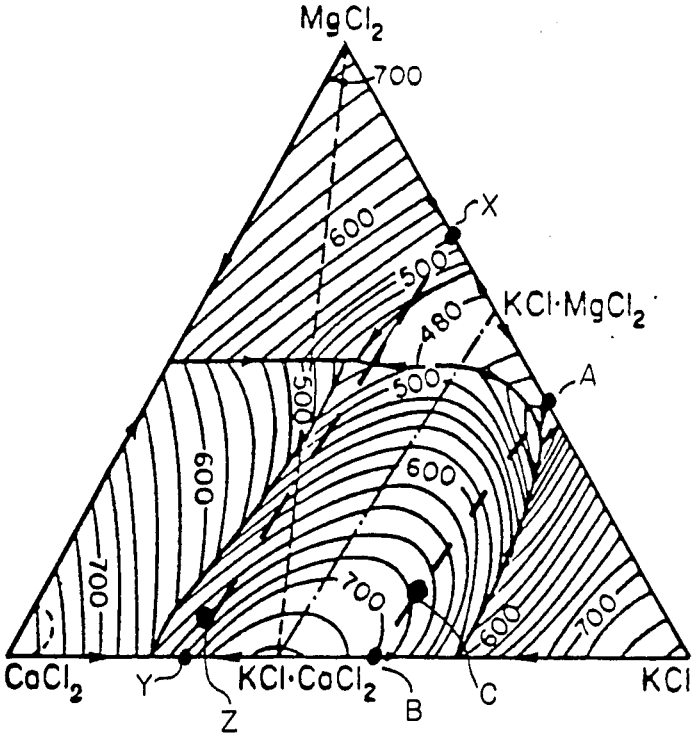
MgCl2
700
600
X
500
480
KCl·MgCl2
500
A
500
600
600
700
700
600
700
CaCl2
Y
Z
KCl·CaCl2
B
C
KCl

MAGNESIUM REFINING PROCESS

BACKGROUND OF THE INVENTION

The invention relates generally to a process for refining crude magnesium metal and, more particularly, to a process for increasing the recovery of magnesium from magnesium crude containing high levels of calcium.

Thermal reduction processes such as the Magnetherm Process (i.e., disclosed in U.S. Pat. No. 2,971,833) produce or recover magnesium containing high levels of calcium (hereinafter referred to as magnesium crude) since the magnesium source ore typically contains high levels of calcium. Conventional commercial processes remove calcium and alkali metals, in addition to various oxides in the crude, by mixing various flux compositions into a crucible containing a molten body of the crude. These fluxes wash the oxides from the crude and react with calcium and the alkali metals to produce a sludge containing calcium chloride, the alkali metal chlorides and oxides. The sludge, being more dense than the crude, settles to the bottom of the crucible thereby enabling the now refined crude to be separated from the sludge. The separated, refined magnesium can then be cast directly into ingots. One flux which has been commercially used to refine magnesium crude contains approximately 40 wt. % magnesium chloride, 55 wt. % potassium chloride and 5 wt. % calcium fluoride and will be referred to hereinafter as M-130 flux.

Sludge produced by the above refining operation generally contains a certain residual but significant amount of magnesium which can also be recovered if subjected to another fluxing operation which is hereinafter referred to as the reclaiming operation or reclaim step. Fluxes which are typically used to reclaim such sludges include M-130, pure potassium chloride and aluminum fluoride, and various combinations thereof.

The use of fluxes to refine or purify magnesium and various other metals and alloys is discussed in U.S. Pat. Nos. 1,524,470, 1,754,788, 4,099,965 and German Patent No. 122,312. While most of these processes presumably work as intended, there is always a need for processes that work better.

SUMMARY OF THE INVENTION

An object of the present invention is to provide a process which increases the recovery of magnesium from magnesium crude.

Another object of the present invention is to provide a process for refining magnesium crude which produces a sludge capable of being reclaimed at low temperatures.

Yet another object of the present invention is to provide a process for refining magnesium crude which uses less refining flux, thereby reducing flux costs.

The present invention provides a process for refining magnesium crude containing between about 0.7 and 1.5 wt. % calcium. The process includes mixing a flux containing from about 55 to 85 wt. % magnesium chloride and 45 to 15 wt. % alkali chlorides into a molten body of the crude. Refined magnesium is thereby produced, as well as a sludge containing calcium chloride which never has a liquidus exceeding the temperature of the molten body. The refined magnesium is then separated from the sludge.

BRIEF DESCRIPTION OF THE DRAWING

The sole FIGURE is a ternary phase diagram illustrating liquidus temperatures for all compositions in a $KCl$-$CaCl_2$-$MgCl_2$ system.

DETAILED DESCRIPTION OF THE PREFERRED EMBODIMENTS

The flux composition for increasing the recovery of magnesium from unrefined magnesium crude in accordance with the process of the present invention can contain from about 55 to 85 wt. % magnesium chloride and 45 to 15 wt. % alkali chlorides, with potassium chloride being the preferred alkali chloride. A more preferred flux composition for use in the process of the present invention can contain from 60 to 80 wt. % magnesium chloride and 40 to 20 wt. % potassium chloride. A typical flux composition for use in the refining process of the process invention contains between about 60 and 70 wt. % magnesium chloride, 40 to 30 wt. % potassium chloride and 0 to 5 wt. % aluminum fluoride.

As previously mentioned, magnesium crude produced by thermal reduction processes, such as the Magnetherm Process, generally contains high levels of calcium, typically between about 0.7 to 1.5 wt. %. To remove this calcium from the crude, fluxes containing magnesium chloride are mixed into a molten body of crude contained in a crucible. The magnesium chloride reacts with the calcium in the crude to produce a sludge containing calcium chloride which settles to the bottom of the crucible. Since the sludge's composition continually changes as the reaction proceeds (i.e., as $MgCl_2$ is replaced by $CaCl_2$), the sludge can freeze or at least become semi-molten since different sludge compositions can have drastically different liquidus temperatures, some of which may approach the temperature of the molten body of crude which is generally held close to about 730° C. (See sole FIGURE which is a ternary phase diagram illustrating the liquidus temperature of all compositions in a $KCl$-$CaCl_2$-$MgCl_2$ system.) Frozen or even semi-molten sludge is desirably avoided since it tends to entrap magnesium in the sludge, thereby reducing recoveries. Moreover, the reclaim of frozen or semi-molten sludges is very difficult. Accordingly, to prevent the sludge from freezing or becoming semi-molten, a flux should be selected that will produce a sludge having a composition that never changes to the point where its liquidus exceeds the crude's temperature. Preferably, the sludge's liquidus should be well below the crude's temperature, preferably at least 70 centigrade degrees below.

The liquidus of the sludge generated when using conventional M-130 flux generally stays below the crude's temperature. The line going from point A to point B in the sole FIGURE illustrates the various liquiduses of the various sludge compositions which are produced as the reaction proceeds with conventional M-130. Point A approximates M-130's composition at the start of the reaction which, as can be seen on the diagram, is approximately 45% magnesium chloride, 55% potassium chloride. It can also be seen that this flux has a liquidus of only 440° C., which is well below that of magnesium. Point B represents the theoretical composition of the sludge after complete reaction of the magnesium chloride with the calcium contained in the crude. In reality, however, the reaction with M-130 flux only proceeds to about point C (i.e., liquidus of 680° C.) and the sludge at this point usually contains approximately 6 to 9 wt. % magnesium chloride. It can also be seen on the diagram that the liquidus of the sludge gradually increases as its composition changes from point A to point C. While the liquidus of M-130 produced sludge never exceeds the crude's temperature, at 680° C. it comes quite close which makes the sludge reclaim step somewhat difficult. Thus, it would be desirable if the final sludge had a lower liquidus, even slightly lower, since this would enable the reclaim operation to be carried out at lower temperatures.

Line XY illustrated in the sole FIGURE illustrates liquidus and compositional changes for a sludge which is generated by a flux composition of the present invention. Point X represents the flux's (i.e., initial sludge) composition prior to its reaction with any calcium in the crude. As can be seen therein, at point X the flux contains approximately 70 wt. % magnesium chloride and 30 wt. % potassium chloride (referred to hereinafter as M-70 flux). It can also be seen that its liquidus is approximately 520° C., and while such is higher than the starting liquidus of M-130 flux, it is still well below the crude's temperature. It can also be seen that as the reaction proceeds towards point Y, that is, as calcium chloride replaces magnesium chloride, as the liquidus of the sludge actually drops first to a minimum of 460° C. before increasing. Moreover, the maximum theoretical liquidus at point Y is only 680° C. which is below that of the M-130 produced sludge which, as previously mentioned, is approximately 700° C. Moreover, the approximate actual liquidus of the final sludge which is represented by point Z in only 660° C. Accordingly, with M-70 flux of the present invention, it is possible to carry out the reclaim operation at lower temperatures. Less sludge is also produced with M-70 flux as opposed to M-130 flux since less inert potassium chloride is added to the system and no calcium fluoride is added. Flux costs are lower since less flux is used.

A number of flux compositions with various concentrations of magnesium chloride were prepared for testing. Table I sets forth data taken from seven runs in which M-70 flux was added and mixed into a crucible containing magnesium crude which was produced by the process disclosed in U.S. Pat. No. 4,478,637, which hereby is incorporated by reference. In addition to M-70 flux, an M-318 flux having a composition of 50 wt. % KCl, 36 wt. % $MgCl_2$ and 14 wt. % $CaF_2$ and an aluminum fluoride flux were added to the crude during the refining step. M-318 flux is a conventional, generally nonreactive inspissating flux which floats on the surface of the molten crude, thereby acting as a cover flux to prevent the crude from oxidation and/or burning. The aluminum fluoride flux serves to strip oxides from the magnesium droplets which improves magnesium coalescence. This also enhances the oxide's entrapment in the sludge. The presence of aluminum fluoride in the sludge also enhances the subsequent reclaim operation, again by enhancing magnesium coalescence. In run 7 of Table I, it will be noted that a relatively high amount (i.e., 375 pounds) of M-318 flux was added during the refining step. It will be noted, however, that only 960 pounds of M-70 flux were mixed. Thus, in the case, those skilled in the art will appreciate that some of the magnesium chloride in the M-318 flux actually entered the crude to react with the calcium. The fluxes listed under the general heading of reclaim were added to the sludge produced by the refining step to reclaim recoverable magnesium contained therein.

Table II sets forth data taken from a second series of 10 runs in which flux containing 80 wt. % magnesium chloride and 20 wt. % potassium chloride (i.e., M-80 flux) was added and mixed into a crucible containing magnesium crude. Again, varying amounts of M-318 and aluminum fluoride flux were added during the refining step. The sludge produced by the refine step was also reclaimed with the indicated fluxes. In run 8, it will be seen that a relatively high amount of M-318 flux was added for reactive purposes to make up for the relatively small amount (i.e., 900 pounds) of M-80 flux added.

Table III sets forth data taken from a third series of two runs which were conducted with a 100% magnesium chloride flux (i.e., an M-100 flux). Again, it will be noted that high amounts of M-318 flux were added to the crude during the refining operation. The M-318 flux was not added initially, however. It was only added after it was observed that the oxides were not properly settling out into the sludge. The M-100 flux was successful, however, in reducing calcium. Thus, it will be appreciated that while an M-100 flux was initially added, the addition of the extra M-318 actually brought the total composition of the flux used for reaction purposes down close to that of an M-70 flux.

Table IV compares the average results from the three series of tests set forth in Tables I, II and III with the average results obtained using standard M-130 flux. The M-130 results were taken from hundreds of commercial runs. It can be seen in Table IV that the average direct cast results (i.e., which is the percentage of magnesium recovered from the crude by the refining step prior to reclaiming) are substantially better with the M-70, M-80 and M-100 fluxes, particularly the M-70 and M-80, than the averages obtained with standard M-130 flux. For example, the M-70 and M-80 fluxes, respectively, produced average direct cast recoveries of 82.2% and 78.0%, both of which are significantly better than the average direct cast recovery obtained with M-130 flux which is only 72.0%. Similarly, total recovery of magnesium after the reclaiming step is better. The M-70, M-80 and M-100 fluxes achieved average total reclaim recoveries of 91.4%, 89.5% and 91.5%, all of which are significantly better than the average recoveries obtained with the M-130 flux which generally runs between about 86 and 87%. It will also be noted that the M-70, M-80 and M100 tests consumed much less flux than that which is normally consumed when refining with conventional M-130 flux. Accordingly, commercial operation with the high magnesium chloride fluxes of the present invention should significantly reduce flux costs.

While, prior to the tests, it was anticipated that the higher magnesium chloride fluxes of the present invention would translate into flux cost savings and easier reclaims, the higher magnesium recoveries were totally unexpected. Why this occurred is not completely understood. It is speculated, however, that the generation of less sludge by these fluxes may entrap less magnesium in the sludge. This would explain the higher direct cast recoveries which, in turn, enable the higher total reclaim recoveries.

TABLE I

M-70 Flux Tests

| Run | Mg Crude (lbs) | Refine M-70 (lbs) | Refine M-318 (lbs) | Refine $AlF_3$ (lbs) | Reclaim M-130 (lbs) | Reclaim KCl (lbs) | Reclaim $AlF_3$ (lbs) | Direct Cast Recovery (%) | Reclaim Recovery (%) |
|---|---|---|---|---|---|---|---|---|---|
| 1 | 19230 | 1320 | 150 | 70 | 375 | 600 | 35 | 80.2 | 81.6 |
| 2 | 15570 | 960 | 75 | 70 | 225 | 1500 | 105 | 86.0 | 97.4 |
| 3 | 20050 | 1260 | 225 | 70 | 150 | 675 | 35 | 85.9 | 95.3 |
| 4 | 20500 | 1320 | 0 | 0 | 750 | 375 | 105 | 77.4 | 89.6 |
| 5 | 19640 | 1200 | 225 | 0 | 300 | 750 | 140 | 87.6 | 95.9 |
| 6 | 18850 | 1140 | 225 | 140 | 225 | 750 | 70 | 82.1 | 93.1 |
| 7 | 19990 | 960 | 375 | 70 | 0 | 375 | 35 | 76.2 | 86.8 |
| avg. | 19118 | 1166 | 182 | 60 | 289 | 718 | 75 | 82.2 | 91.4 |

TABLE II

M-80 Flux Tests

| Run | Mg Crude (lbs) | Refine M-70 (lbs) | Refine M-318 (lbs) | Refine $AlF_3$ (lbs) | Reclaim M-130 (lbs) | Reclaim KCl (lbs) | Reclaim $Alf_3$ (lbs) | Direct Cast Recovery (%) | Reclaim Recovery (%) |
|---|---|---|---|---|---|---|---|---|---|
| 1 | 21960 | 1500 | 75 | 70 | 675 | 300 | 70 | 65.8 | 88.5 |
| 2 | 18860 | 1440 | 225 | 0 | 150 | 675 | 70 | 74.2 | 90.2 |
| 3 | 18480 | 1140 | 150 | 70 | 225 | 375 | 70 | 87.3 | 95.5 |
| 4 | 18200 | 1080 | 150 | 70 | 375 | 600 | 70 | 85.2 | 95.2 |
| 5 | 21070 | 1260 | 75 | 70 | 525 | 1125 | 105 | 81.6 | 91.7 |
| 6 | 15660 | 900 | 300 | 70 | 225 | 1050 | 70 | 79.0 | 88.7 |
| 7 | 18990 | 1200 | 225 | 0 | 300 | 1200 | 70 | 77.8 | 86.1 |
| 8 | 18950 | 900 | 825 | 70 | 375 | 600 | 105 | 76.4 | 85.6 |
| 9 | 17700 | 1020 | 225 | 70 | 600 | 0 | 0 | 77.4 | 86.6 |
| 10 | 18430 | 840 | 225 | 70 | 450 | 750 | 35 | 75.4 | 86.8 |
| avg. | 18830 | 1128 | 248 | 56 | 390 | 668 | 66 | 78.0 | 89.5 |

TABLE III

M-100 Flux Tests

| Run | Mg Crude (lbs) | Refine M-70 (lbs) | Refine M-318 (lbs) | Refine $AlF_3$ (lbs) | Reclaim M-130 (lbs) | Reclaim KCl (lbs) | Reclaim $AlF_3$ (lbs) | Direct Cast Recovery (%) | Reclaim Recovery (%) |
|---|---|---|---|---|---|---|---|---|---|
| 1 | 20360 | 780 | 675 | 0 | 300 | 675 | 140 | 77.7 | 91.7 |
| 2 | 19450 | 840 | 675 | 35 | 225 | 900 | 140 | 73.9 | 91.3 |
| avg. | 19905 | 810 | 675 | 18 | 262 | 788 | 140 | 75.8 | 91.5 |

TABLE IV

| Flux | Average Crude (lbs.) | Refine Fluxes M-130 | Refine Fluxes M-70 | Refine Fluxes M-80 | Refine Fluxes M-100 | Refine Fluxes M-318 | Refine Fluxes $AlF_3$ | Reclaim Fluxes M-130 | Reclaim Fluxes KCl | Reclaim Fluxes $AlF_3$ | Total Flux (lbs) | Direct Cast Recovery (%) | Reclaim Recovery (%) |
|---|---|---|---|---|---|---|---|---|---|---|---|---|---|
| M-130 | 18,928 | 2021 | — | — | — | 207 | 125 | 319 | 540 | 48 | 3260 | 72.0 | 86–87 |
| M-70 | 19,118 | — | 1166 | — | — | 182 | 60 | 289 | 718 | 75 | 2490 | 82.2 | 91.4 |
| M-80 | 18,830 | — | — | 1128 | — | 228 | 56 | 390 | 668 | 66 | 2536 | 78.0 | 89.5 |
| M-100 | 19,905 | — | — | — | 810 | 675 | 18 | 262 | 788 | 140 | 2693 | 75.8 | 91.5 |

While the invention has been described in terms of preferred embodiments, the claims appended hereto are intended to encompass all embodiments which fall within the spirit of the invention.

What is claimed is:

1. A process for refining magnesium crude provided by thermally reducing a magnesium source ore, the crude containing between about 0.7 and 1.5 wt. % calcium, said process comprising:

(a) providing a molten body of said magnesium crude;

(b) mixing a flux containing from 55 to 85 wt. % magnesium chloride and 45 to 15 wt. % of at least one alkali chloride into the body, wherein during said mixing a substantial portion of the calcium reacts to remove substantially all of the calcium in the crude, said mixing producing refined magnesium and a sludge containing calcium chloride resulting from the reaction of said calcium with said magnesium chloride; and (c) separating the refined magnesium from the sludge.

2. A process as recited in claim 1 wherein the sludge's liquidus never exceeds 700° C.

3. A process as recited in claim 1 wherein the sludge's liquidus never exceeds 660° C.

4. A process as recited in claim 1 wherein the alkali chloride is potassium chloride.

5. A process as recited in claim 4 wherein the flux contains about 60 to 80 wt. % magnesium chloride and 40 to 20 wt. % potassium chloride.

6. A process as recited in claim 1 wherein the sludge is characterized by never having a liquidus exceeding the temperature of the molten body.

7. A process as recited in claim 1 wherein the crude is provided by thermally reducing an MgO containing source.

8. A process as recited in claim 1 wherein the flux contains up to 5 wt. % $AlF_3$ or $MgF_2$.

9. A process for refining magnesium crude provided by thermally reducing a magnesium source ore, the crude containing between about 0.7 and 1.5 wt. % calcium, said process comprising:

(a) providing a molten body of said crude having a predetermined temperature;

(b) maintaining said predetermined temperature;

(c) mixing a flux containing from 60 to 80 wt. % magnesium chloride and 40 to 20 wt. % potassium chloride into the body of crude, wherein during said mixing a substantial portion of the calcium reacts to remove substantially all of the calcium in the crude, said mixing producing refined magnesium and a sludge containing calcium chloride, said sludge being characterized by always having a liquidus at least 70 centigrade degrees below the crude's predetermined temperature, said flux also being characterized by being capable of recovering more magnesium from said crude than fluxes containing less than 55 wt. % magnesium chloride; and (d) separating the refined magnesium from the sludge.

* * * * *

UNITED STATES PATENT AND TRADEMARK OFFICE

CERTIFICATE OF CORRECTION

PATENT NO. : 4,695,320

DATED : September 22, 1987

INVENTOR(S) : Roy A. Christini et al

It is certified that error appears in the above-identified patent and that said Letters Patent is hereby corrected as shown below:

Col. 3, line 33 Change "in" to --is--.

Signed and Sealed this

Ninth Day of February, 1988

*Attest:*

DONALD J. QUIGG

*Attesting Officer*

*Commissioner of Patents and Trademarks*